United States Patent [19]

Gamadia

[11] 4,220,264

[45] Sep. 2, 1980

[54] PUMP DISPENSERS

[75] Inventor: Rustom K. Gamadia, London, England

[73] Assignee: Lever Brothers Co., New York, N.Y.

[21] Appl. No.: 946,116

[22] Filed: Sep. 27, 1978

[30] Foreign Application Priority Data

Sep. 27, 1977 [GB] United Kingdom ..... 40093/77

[51] Int. Cl.[2] ..... B65D 37/00

[52] U.S. Cl. ..... 222/207; 222/211; 222/214; 222/336; 222/383

[58] Field of Search ..... 222/378, 379, 207, 211, 222/212, 214, 215, 383, 382, 336, 340, 386.5, 321

[56] References Cited

U.S. PATENT DOCUMENTS

| | | | |
|---|---|---|---|
| 4,136,802 | 1/1979 | Mascia et al. | 222/386.5 X |
| 4,142,653 | 3/1979 | Mascia et al. | 222/207 |

*Primary Examiner*—Allen N. Knowles

[57] ABSTRACT

A hand operated pump dispenser adapted to be fitted to a fluid container to dispense the fluid as a spray has a discharge reservoir in the form of a bellows having an inlet closed by a one way valve allowing fluid into the bellows and a finger operated discharge valve, the bellows being charged and discharged by movement of the inlet relative to the housing, the charging movement of the bellows inlet also energizing an energy storage spring and being effected either by rotation or downward pressure on a first actuating member.

7 Claims, 4 Drawing Figures

PUMP DISPENSERS

The present invention relates to pump dispensers, particularly of the kind which are fitted at the top of a container and by finger operation may discharge a spray.

Aerosols are a widely used form of dispenser, but are increasingly becoming subject to restriction as the gaseous propellants used are increasingly being considered as environmentally unacceptable.

As an alternative to the conventional fluorocarbon based aerosol system, various forms of spring operated piston and cylinder pump dispensers have been proposed. However there are problems in prevention of leakage down the cylinder walls, when such systems are used, and the systems also tended to become rather complex. In particular with a plastic piston and cylinder arrangement a feature edge seal became less and less effective as the piston area is increased (due to the reduced stiffness), whereas O ring seals of neoprene or rubber absorb alcohol and expand in use, causing undue stiffness. Following from the leakage problem, in multi component products to be dispensed, the more volatile component often tends to separate and evaporate differentially or otherwise leak out, leaving the thicker component to block the mechanism.

Another aspect of the design of such pumps is that the mechanism tends to become rather complex when finger pressure is used to generate pressure in a spring for discharge of the contents.

By the present invention the actuation for storage of spring energy and for discharge of the pump are kept separate, and the piston and cylinder chamber system usually used is replaced by a collapsible bellows. With these two measures in combination a particularly simple and effective pump dispenser can be achieved.

Accordingly the present invention provides a hand operated pump dispenser for fitment to a fluid container comprising

- a discharge reservoir for storage of fluid for discharge under pressure;
- an inlet means including a one way valve for ingress of fluid from the fluid container into said discharge reservoir;
- a first actuating member for storage of energy in a spring to provide pressure for the discharge of fluid from the reservoir; and
- a second actuating member including a discharge valve for discharge of fluid under pressure from the discharge reservoir, said discharge reservoir being in the form of a bellows which is arranged to expand on actuation of the first actuating member to draw fluid in via the one way valve, and is arranged on actuation of the second actuating member to be forced to collapse due to release of said spring energy to discharge the fluid under pressure via the discharge valve.

Since the bellows inlet is sealed by a one way valve and the bellows discharge by the discharge valve the force developed within the spring is capable of being held by the trapped fluid under hydraulic pressure within the bellows, i.e. the system will remain in equilibrium (with the reaction to the compressed fluid balancing the spring force) without any necessity to hold the first actuating member in the position in which the energy is stored in the spring—the first actuating member will stay at the point to which it is pressed down until the fluid is discharged. Alternatively if it is considered undesirable to hold a high hydraulic pressure in the bellows for any length of time the first actuating member can be held down in other ways until actuation of the second actuating member.

According to another aspect of the present invention there is provided a hand operated pump dispenser comprising a housing adapted for fitment to a fluid container, a discharge reservoir in the form of a bellows having a discharge end and an inlet end, the discharge end being in a fixed position relative to the housing, a first actuating member arranged to expand the bellows by moving the inlet end of the bellows, the inlet end of the bellows having inlet means including a one way valve for the ingress of fluid into the bellows, spring means energised by movement of the first actuating means to expand the bellows and effective to pressurise fluid contained in the bellows and second actuating means including a finger operated discharge valve at the discharge end of the bellows for the discharge of fluid under pressure from the bellows.

Because the discharge end of the bellows is in a fixed position relative to the housing it is in the same position whether the bellows is charged or discharged. Thus a simple fixed connection can be provided between the discharge valve of the second actuating means and the discharge end of the bellows thus providing that as the contents of the bellows are discharged the position of the discharge valve relative to the housing does not change. This greatly facilitates the use of the dispenser.

Preferably the one way valve comprises a seating integrally formed in the inlet end of the bellows. Providing the one way valve seat integral with the bellows eliminates a possible source of leakage of fluid under pressure from the bellows if a connection were to be made between the inlet end of the bellows and the one way valve.

A moving member can conveniently be secured to the inlet end of the bellows adapted to be moved by the first actuating member to expand the bellows. Preferably the first actuating member is actuated by an overcap (e.g. of the kind used on aerosols). This may be designed for actuation by being directly pushed down to expand the bellows, for example by pressure from the heel of the hand with the container standing on a firm surface.

To facilitate assembly of the dispenser a snap connection can be provided between the inlet end of the bellows and the moving member.

The moving member is preferably splined to the housing to prevent rotation of the moving member relative to the housing. This avoids any tendency of the bellows to be twisted as it is expanded by the moving member or as it contracts under the influence of the spring means.

The first actuating member can comprise a rotatable member threadably engaged with the moving member, rotation of the first actuating member moving the member to expand the bellows. In this arrangement the first actuating member can be actuated by an overcap which engages with the first actuating member to enable rotation of the overcap to be transmitted to the first actuating member.

The housing can be provided with an end wall, the inlet means passing through an aperture in said end wall with a sealing grommet sealing the inlet means within the aperture to prevent fluid entering the housing whilst allowing venting air to enter the fluid container. There is thus provided a venting means for the fluid container which allows air to enter as the fluid contents are transferred to the dispenser, the venting means preventing fluid entering the pump housing and causing any malfunctioning or leaking therefrom.

A clamp member can be provided, a first end of which clamps the discharge end of the bellows to the second actuating means, a second end of the clamp means contacting the housing. In this way the discharge end of the bellows can be maintained in a fixed position relative to the housing. The second end of the clamp member can be secured to the housing thereby transmitting the fluid pressure on the second actuating means to the housing.

Generally the dispenser will be a snap or screw fit on to the neck of an aerosol container, or a plastic bottle or other similar container; and the inlet means will include a dip tube extending to the container. Other arrangements where a dip tube is not used (e.g. discharge when inverted) or where the dispenser is attached at some other point on a fluid container are also possible.

To provide for ease of manufacture and assembly the inlet end of the bellows can be provided with an extension integral therewith which extends through the sealing grommet in the end wall of the housing and can be adapted for the attachment of a dip tube directly thereto.

Embodiments of the present invention will now be described by way of example with reference to the accompanying diagrammatic drawings in which.

Figure 1:
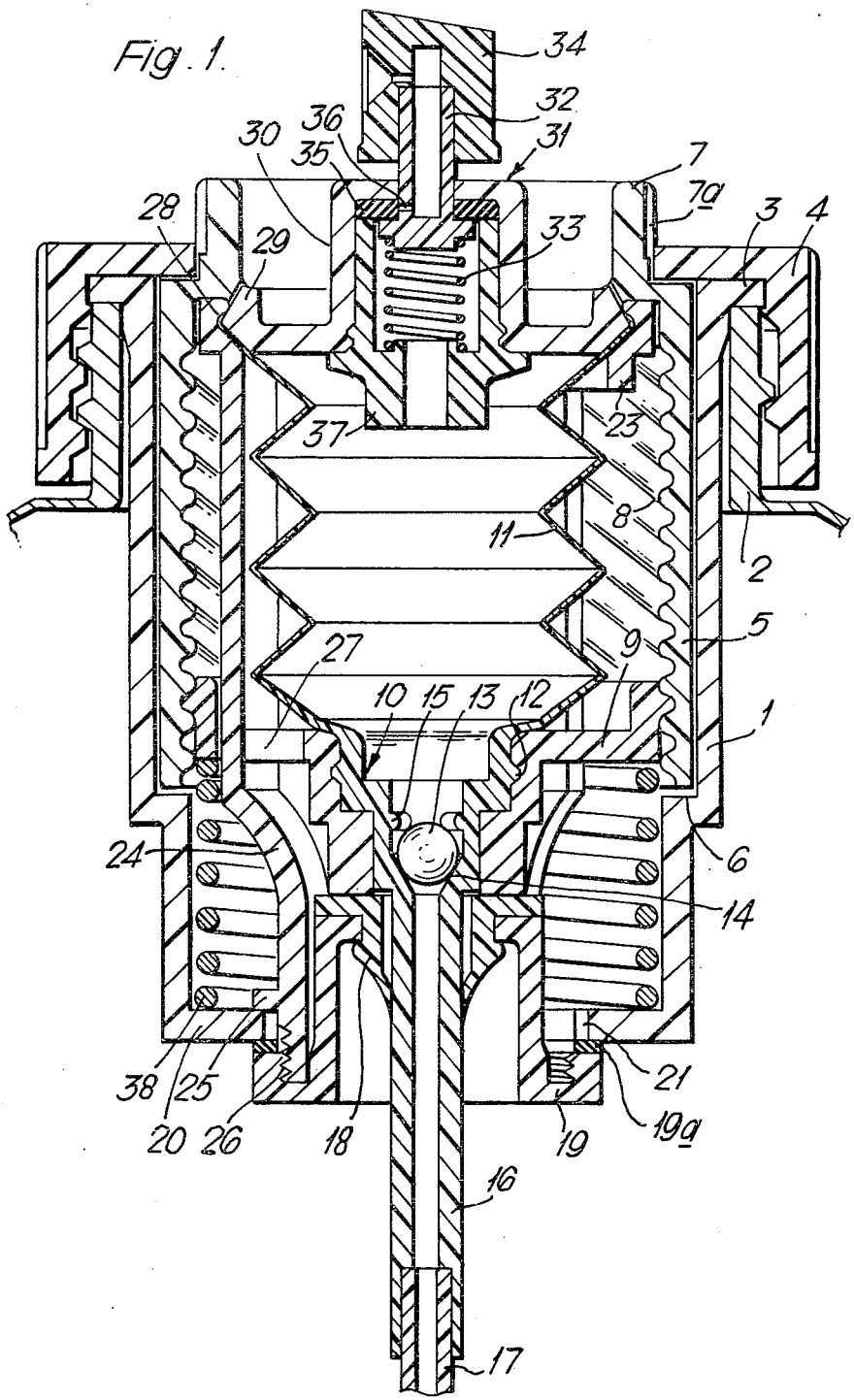
FIG. 1 is a cross-sectional side elevation of a first embodiment.

Referring to FIG. 1 the pump dispenser comprises a cylindrical housing 1 which can be inserted in the neck 2 of a fluid container such as a bottle or can of a conventional kind (not shown). The housing 1 is provided with an outwardly extending flange 3 to which engages the top of the neck 2 and is clamped thereto by a neck fitment member 4 which is threadably engaged with the neck.

Rotatably located within the housing is a first actuating member 5 which is retained in the housing by the neck fitment member 4 whilst excessive vertical movement is prevented by an annular step 6 in the inside of the housing. The first actuating member 5 extends at 7 above the neck fitment member and is provided with teeth or grooves *7a* which can be gripped and turned, either by hand or with a correspondingly shaped ring or cap. The inside of the first actuating member 5 is provided with a thread 8 which engages the threaded periphery of the moving member 9 shown also in FIG. 2. Secured within the central bore of the moving member 8 is the inlet end 10 of a discharge reservoir formed by a bellows 11. The wall thickness of the bellows 11 is relatively thin to allow flexing, the wall thickness being increased at the inlet end to impart rigidity thereto, the outer surface of the inlet end and the inner bore of the movable member being shaped to provide a snug fit as indicated at 12. A one way valve of the inlet means is formed by a ball 13 and a seating 14 formed integrally with the bellows. A shoulder 15 prevents the ball 13 from being accidentally displaced.

Figure 2:
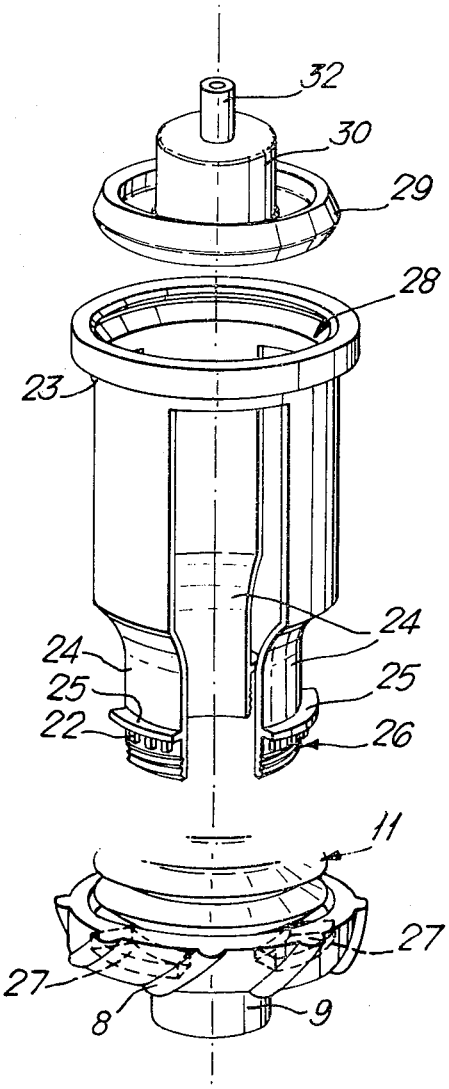
FIG. 2 is an exploded perspective view of the clamp member, second actuating means and moving member of the pump of FIG. 1.

The inlet means further includes a tubular extension 16 of the bellows in the bottom of which a dip tube 17 is secured. The tubular extension 16 passes through a sealing grommet 18 snap-fitted into an aperture in a recessed locking ring 19 forming part of the end wall of the housing. The housing has an annular end wall part 20 the inner periphery of which is splined at 21 to receive spline 22 of an annular clamp member 23 as shown in FIG. 2.

Splines 22 are formed on three legs 24 of the clamp member 23 the legs each being provided with aligned outwardly extending shoulders 25 and a threaded portion 26. The legs of the clamp member are locked to the end wall of the housing by the locking ring 19 engaging the threaded portion 26. A sealing ring 19*a* ensures a fluid tight seal between the retaining ring 19 and the end wall part 20 of the housing.

The legs 24 pass through apertures 27 in the moving member, the apertures being dimensioned to allow for insertion of the legs therein but limiting relative rotational movement therebetween to a minimum.

The top of the clamp member 23 is provided with a locking groove 28 which snap fits with a co-operating flange 29 on a discharge valve housing 30 to clamp therebetween the upper discharge end of the bellows 11. A discharge valve 31 is formed by a conventional discharge valve having a hollow tube 32 loaded against a spring 33 and carrying at its upper end a discharge actuator 34 in the form of a spray nozzle, the hollow tube running through a gasket 35. The tube has a lateral passage 36 leading into its bore at a position intermediate its length while the lower end of this bore is sealed. Thus pushing the actuator down against the spring 33 brings the passage 36 and thus the bore into communication with the interior of the bellows.

A tubular member 37 which retains the spring 33 in the housing also extends into the bellows 11 for reasons explained below.

Disposed between the end wall part 20 of the housing and the moving member 9 is an energy storage spring 38 which is shown in FIG. 1 in the compressed condition, the bellows being in the expanded position. Thus in the illustrated position the bellows contains fluid to be discharged and under pressure from the energy stored in the spring 38. The fluid in the bellows is trapped between the discharge valve and the one way inlet valve so the system is in equilibrium. Pressing the discharge actuator 34 opens the discharge valve and allows fluid under hydraulic pressure to be discharged from the bellows. When this happens the spring 38 gradually forces the moving member 9 in the upward direction. The moving member is prevented from rotating relative to the housing by the fixed legs 24 of the clamp member in the apertures 27. Thus as the moving member rises up the first actuating member 5 is caused to rotate.

Discharge of fluid under pressure terminates when the tubular member 37 contacts the inlet end of the bellows and prevents further upward movement. In this position the bellows is substantially collapsed and the presence of the tubular member 37 minimises the free volume within the bellows in this position. This reduces any problem caused in initial charging of the system and reduces the number of actuations necessary to remove air from the bellows by making the dead volume of the bellows as small as possible.

Figure 3:
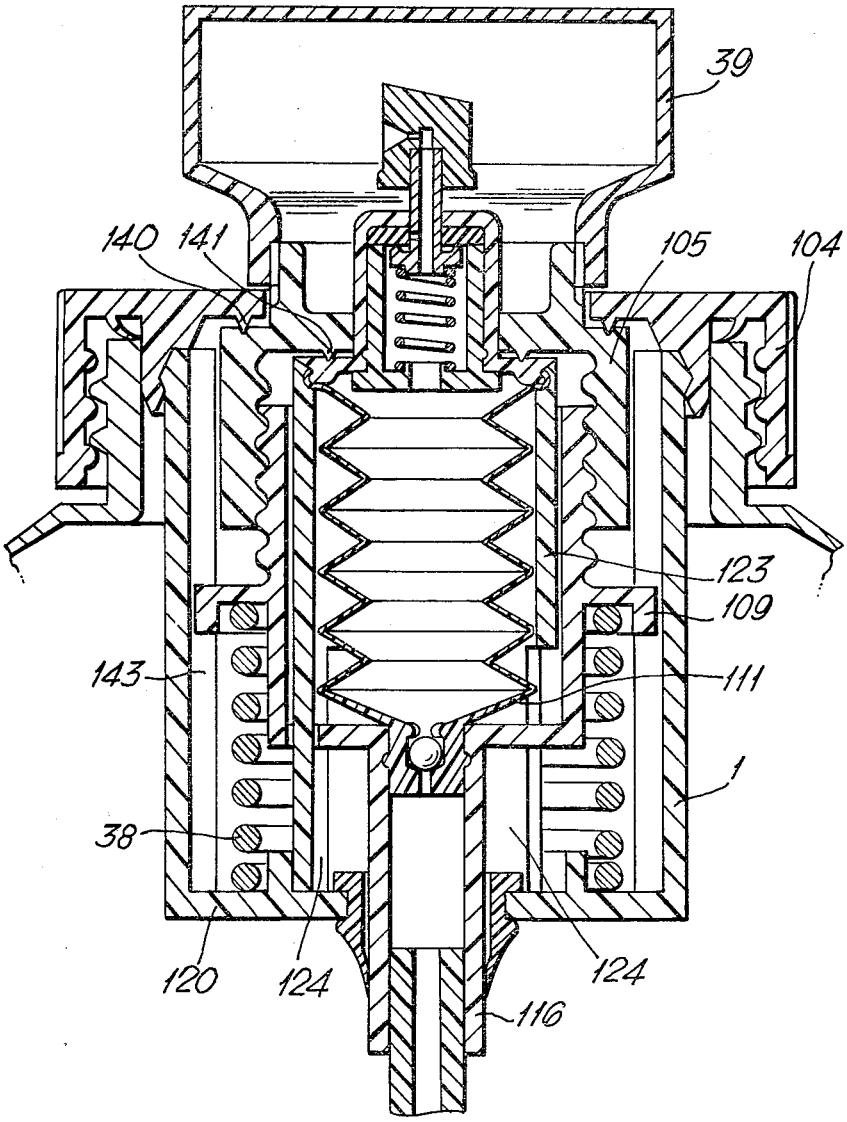
FIG. 3 is a cross-sectional side elevation of a second embodiment.

To charge the system the first actuating member 5 is rotated, e.g. by an overcap 39 as shown in FIG. 3. This causes the moving member 9 to move downwardly and expand the bellows by moving the inlet end of the bellows. A suction is created in the bellows and the one way valve opens to allow fluid from the container on which the dispenser is mounted to enter the bellows via the dip tube 17. As the moving member travels downwards the spring 38 is compressed and when the rotational force on the first actuating member 5 is removed spring pressure is applied via the moving member 9 to pressurise the contents of the bellows.

As the dispenser is charged and discharged the tubular extension 16 of the bellows slides in the sealing grommet 18. The grommet prevents fluid from the containers entering the dispenser housing if the container and dispenser is inverted. Thus the fluid content of the container cannot contact and attack any vulnerable components such as the spring 38 which will be of metal whereas the majority of the other parts can be of a plastics or other material which is not subject to attach by the fluid contents. Similarly the fluid contents are prevented from reaching the thread 8 or any other part of the dispenser and prevent proper working thereof. The grommet does however allow air to enter the container as the fluid contents are reduced, the air reaching the grommet through the various working clearances in the dispenser.

The sealing grommet is the only sliding seal in the dispenser and it will be appreciated that this seal is not subjected to any high pressure.

It will also be noted that during discharge of the contents of the bellows the discharge actuator remains in the same position relative to the housing. This greatly facilitates using the dispenser because an even finger pressure can be applied to the actuator by a user without the grip on the container having to be changed. The dip tube will move up and down slightly during use but this in no way adversely affects operation.

Referring now to FIG. 3 there is shown an alternative embodiment in a partially charged condition. The construction of this embodiment follows closely that of FIGS. 1 and 2 the differences will now be described.

The clamp member 123 again has three legs 124 but the lower ends of the legs are not secured to the end wall 120 of the housing 1. Thus the pressure of the spring 38 is transmitted via the moving member 109 to the bellows 111 and thus to the first actuating member 105 which is retained in position by the neck fitment member 104. Thus the hydraulic pressure created by the spring 38 is resisted by the neck fitment member holding the dispenser from the fluid container. Friction between the first actuating member 105 and the neck fitment member 104 on the one hand and the discharge valve housing 130 on the other hand must be overcome both during charging and discharging of the bellows thus reducing the effective pressure on the fluid in the bellows. The friction can be minimised by providing for substantially line contact between the relatively rotating parts as is shown at 140 and 141. Nevertheless this construction is a simplification of that of FIG. 1 which involves an additional member 19 and splines 22, shoulders 25 and a thread 26 on the ends of the legs 24. Assembly of the dispenser is also simplified.

Another modification as compared to FIG. 1 is that the tubular extension 16 of the bellows of FIG. 1 is formed as a tubular extension 116 of the moving member 109 in the second embodiment shown in FIG. 3. Whilst this enlarges the member 109 as compared to member 9 the bellows is somewhat simplified.

Operation of the pump dispenser of FIG. 3 is as described with reference to the embodiment of FIGS. 1 and 2. Rotation of member 109 is prevented by splines 143.

Referring now to FIG. 4 there is shown, again in partially charged condition, a simplified dispenser in which the first actuating member 205 is formed integrally as an upward annular extension of the moving member 209. The upper region of the first actuating member 205 is formed as three legs 242 which pass through apertures in the neck fitment member 204 and can be engaged above the neck fitment member by a suitably shaped overcap 239.

The outer periphery of the moving member 209 has splines which engage with corresponding splines 243 on the inside of the housing 201 to allow the moving member to move vertically in the housing but prevent relative rotation.

Figure 4:
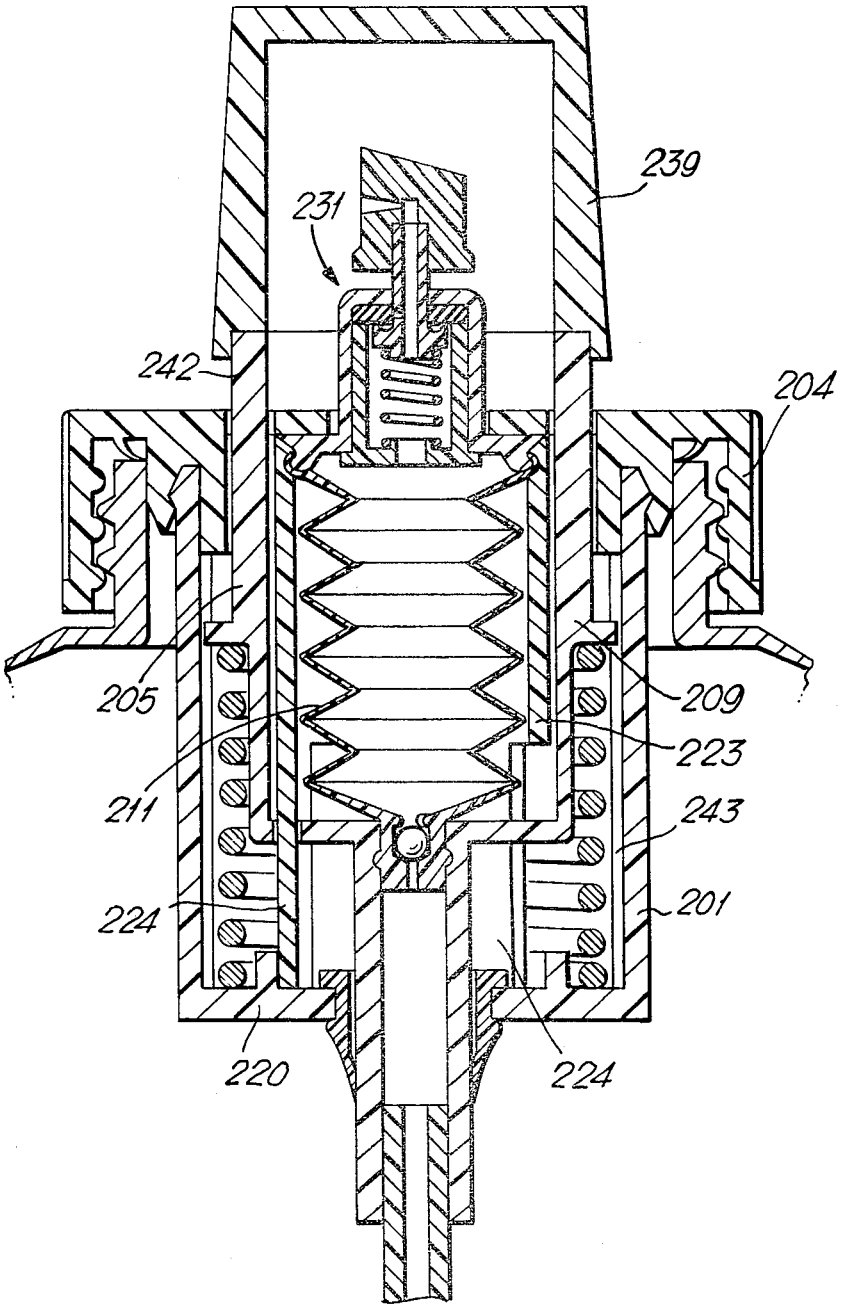
FIG. 4 is a cross-sectional side elevation of a further embodiment.

To charge the dispenser of FIG. 4 the first actuating member 205 and hence the moving member 209 is simply pushed downwards by pressure applied to the overcap 239. Discharge of fluid under pressure from the bellows 211 is effected as before by opening the discharge valve 231 and as the contents of the bellows is discharged the moving member moves vertically upwards.

Rotation of the moving member relative to the housing which rotation would twist the bellows, could of course be avoided by securing the legs 244 of the clamp member 223 to the end wall 220 of the housing as in the embodiment of FIG. 1 thereby avoiding the splined connection between the moving member and the housing. Another modification of the design of FIG. 4 would be to provide the overcap with legs which could be entered through slots in the neck fitment rubber 204 to engage the top of the moving member for charging purposes.

Actuation for charging is easily effected by hand pressure (e.g. force from the hand of 5 to 10 Kg weight) and an adequate quantity (e.g. 3 or 4 ml) can be stored for discharge at a satisfactory pressure (e.g. 5.5 $Kg/cm^2$).

The dispenser of FIG. 4 embodies a minimum number of components which greatly facilitates the assembly operation during manufacture. The majority of the components of all the embodiments can be readily manufactured from suitable material such as a plastics material by injection moulding. Whilst the embodiments of FIGS. 1 to 3 are more complex the rotational charging action has the advantage of requiring less force for the charging operation.

What is claimed is:

1. A hand operated pump dispenser comprising a housing adapted for fitment to a fluid container with the housing extending into the fluid containing container space, a discharge reservoir in the form of a bellows having a discharge end and an inlet end, the discharge end being in a fixed position relative to the housing, a first actuating member having a portion extending outwardly through the top of the housing and movable within the housing to expand the bellows by moving the inlet end of the bellows relative to the housing, the inlet end of the bellows having inlet means including a one way valve for the ingress of fluid into the bellows and a tubular extension extending through the housing and in sealing engagement therewith, spring means energised by movement of the first actuating means to expand the bellows and effective to pressurise fluid contained in the bellows, and second actuating means including a finger operated discharge valve at the discharge end of the bellows for the discharge of fluid under pressure from bellows.

2. A dispenser according to claim 1 comprising a clamp member a first end of which clamps a discharge end of the bellows to the second actuating means, a second end of the clamp means being secured to the housing to transmit fluid pressure on the second actuating means to the housing.

3. A dispenser according to claim 1 in which the first actuating member is rotationally mounted within the housing and threadably connected with the inlet end of the bellows whereby rotation of the first actuating member expands the bellows.

4. A dispenser according to claim 1 in which the first actuating member is movable axially relative to the housing and directly connected to the inlet end of the bellows.

5. A dispenser according to claim 3 including a moving member secured to the inlet end of the bellows and splined to the housing to prevent relative rotation therebetween, the first actuating member threadably engaging the moving member.

6. A hand operated pump dispenser comprising a housing adapted for fitment to a fluid container, a discharge reservoir in the form of a bellows having a discharge end and an inlet end, the discharge end being in a fixed position relative to the housing, a first actuating member arranged to expand the bellows by moving the inlet end of the bellows, the inlet end of the bellows having inlet means including a one way valve for the ingress of fluid into the bellows, spring means energised by movement of the first actuating means to expand the bellows and effective to pressurise fluid contained in the bellows and second actuating means including a finger operated discharge valve at the discharge end of the bellows for the discharge of fluid under pressure from the bellows, the one way valve comprising a seating integrally formed in the inlet end of the bellows, and including a moving member secured to the inlet end of the bellows and adapted to be moved by the first actuating member to expand the bellows, the moving member being splined to the housing to prevent rotation of the moving member relative to the housing.

7. A dispenser according to claim 6 in which the first actuating member comprises a rotatable member threadably engaged with the moving member, rotation of the first actuating member moving the moving member to expand the bellows.

* * * * *